US006245722B1

(12) United States Patent
Maples et al.

(10) Patent No.: US 6,245,722 B1
(45) Date of Patent: Jun. 12, 2001

(54) SILICONE WAX-BASED DRY LUBRICANT

(75) Inventors: Paul D. Maples, 3198 Beachcomber Dr., Morro Bay, CA (US) 93442; Matt O'Rourke, Los Osos, CA (US)

(73) Assignee: Paul D. Maples, Morro Bay, CA (US)

( * ) Notice: Subject to any disclaimer, the term of this patent is extended or adjusted under 35 U.S.C. 154(b) by 0 days.

(21) Appl. No.: 09/145,879

(22) Filed: Sep. 2, 1998

Related U.S. Application Data

(60) Provisional application No. 60/057,879, filed on Sep. 3, 1997, now abandoned.

(51) Int. Cl.[7] ..... C10M 107/50
(52) U.S. Cl. ..... 508/208
(58) Field of Search ..... 508/208

(56) References Cited

U.S. PATENT DOCUMENTS

| | | | | |
|---|---|---|---|---|
| 1,694,148 | | 12/1928 | Spalding . | |
| 1,920,202 | | 8/1933 | Lange et al. . | |
| 1,935,588 | | 11/1933 | Cabot et al. . | |
| 1,953,904 | | 4/1934 | Bowyer et al. . | |
| 2,386,553 | | 10/1945 | Hilliker et al. . | |
| 2,391,113 | | 12/1945 | Zimmer et al. . | |
| 2,393,797 | | 1/1946 | Morgan et al. . | |
| 2,418,075 | | 3/1947 | Kollen et al. . | |
| 2,419,713 | | 4/1947 | Flood et al. . | |
| 2,444,357 | | 6/1948 | Maguire et al. . | |
| 2,644,802 | | 7/1953 | Lontz et al. . | |
| 3,395,169 | * | 7/1968 | Mitchell | 260/448 |
| 3,563,941 | * | 2/1971 | Plueddemann | 260/28 |
| 3,664,956 | | 5/1972 | Messina et al. . | |
| 3,692,678 | | 9/1972 | Stiffler et al. . | |
| 3,793,198 | | 2/1974 | Chapman . | |
| 4,260,500 | | 4/1981 | Forsberg . | |
| 4,269,739 | | 5/1981 | Grejsner . | |
| 4,731,189 | | 3/1988 | Gregg, Jr. . | |
| 5,208,038 | * | 5/1993 | Gressani et al. | 424/489 |
| 5,338,312 | | 8/1994 | Montgomery . | |
| 5,393,442 | | 2/1995 | Buchwald et al. . | |
| 5,472,625 | | 12/1995 | Maples . | |
| 5,645,751 | | 7/1997 | Haley . | |
| 5,656,680 | | 8/1997 | Aguirre et al. . | |

FOREIGN PATENT DOCUMENTS

| | | | |
|---|---|---|---|
| 0586312 | * | 8/1993 | (JP) . |
| 0848942 | * | 8/1994 | (JP) . |
| WO 99/11742 | | 3/1999 | (WO) . |

OTHER PUBLICATIONS

J.M. Ziegler & F.W. Gordon Fearson (1989) Silicone–based Polymer Science, A comprehensive Reference.

Encyclopedia of Polymer Science & Technology, vol. 12 pp. 464–569, Interscience, New York 1970.

* cited by examiner

*Primary Examiner*—Margaret Medley
*Assistant Examiner*—Cephia D. Toomer
(74) *Attorney, Agent, or Firm*—Knobbe Martens Olson & Bear, L.L.P.

(57) ABSTRACT

A high performance lubricant that includes a silicone wax that has been dissolved in solvent, emulsified or suspended in an inert carrier is described. In addition, a method is discussed of lubricating the solid surfaces of moving parts with a relatively water resistant, dry lubricant. The lubricant repels water and sheds dirt. Thus, this lubricant is particularly useful for lubricating high performance products that are used in a dirty environment.

20 Claims, No Drawings

SILICONE WAX-BASED DRY LUBRICANT

RELATED APPLICATIONS

This application is related to U.S. Provisional application 60/057,879 filed on Sep. 3, 1997, now abandoned.

BACKGROUND

1. Field of the Invention

This invention relates to lubricants, and more particularly to lubricants based on silicone waxes to produce a relatively dry lubricant for mechanical devices that are typically exposed to dirty or dusty environments.

2. Related Art

Lubricants are used to coat mechanical surfaces with a thin film to reduce friction, heat and wear between solid surfaces. In addition to reducing friction, lubricants, particularly wax-based lubricants, can protect mechanical surfaces by sealing them from exposure to water and particulate matter that can corrode or damage the surface, particularly metal surfaces.

Silicones refer to organosilicon oxide polymers in which the structural unit is typically —$R_2$Si—O—, where R is an organic radical (e.g., methyl, phenyl). Silicones can be fluids, resins, elastomers or a powder. The physical properties of silicone polymers depend on the size and type of R radical, the R:Si ratio, and the polymeric molecular configuration (e.g., linear, cyclic or combination thereof, and degree of crosslinking). These semiorganic polymers are generally heat stable and water repellent, and have been used as in lubricants, hydraulic oils, adhesives, synthetic rubbers and other elastomers, mold releasing compositions, paints and enamels, water repellents, cosmetics and pharmaceuticals. The chemistry and manufacturing of silicones is well known (e.g., as reviewed in *Encyclopedia of Polymer Science and Technology*, vol. 12, pp. 464–569, Interscience, New York, 1970).

Some silicone-containing lubricants and their uses are described, for example, in U.S. Pat. Nos. 5,338,312, 5,393,442, 4,731,189 and 4,269,739. Polymer-containing lubricants have been described in U.S. Pat. No. 1,935,588. Other types of lubricants and additives for lubricants known in the art, as described in U.S. Pat. Nos. 3,692,678 and 4,260,500. Lubricants that include soaps are disclosed in U.S. Pat. Nos. 1,920,202, 1,953,904, 2,386,553, 2,391,113, 2,393,797, 2,418,075 and 2,419,713.

Lubricants that remain relatively liquid after application to a mechanism are undesirable for certain environments and machinery. For example, mechanical devices that are exposed to dust or dirt will collect and retain contaminants in a liquid lubricant, eventually causing abrasion and limiting performance of the mechanism. Liquid lubricants also expose the user or products to soiling (e.g., fabrics produced by textile-manufacturing machines). Liquid or semi-liquid lubricants are inappropriate for many types of mechanisms that move at high speeds (e.g., drills, saw blades or chains) because the lubricant will be thrown off of the device by centrifugal or vibrational force on the mechanism. For such uses, dry lubricants or solid lubricants applied to hot metal are often preferred.

Relatively dry lubricants and their uses for coating mechanical devices are known. For example, U.S. Pat. No. 1,694,148 discloses a lubricant suitable for dry lubrication of textile machines. Liquid lubricants that contain salts of fatty acids and become relatively dry after application to bicycle chains are disclosed in U.S. Pat. No. 5,472,625 and allowed U.S. patent application Ser. No. 08/566,680. Solid lubricants that contain waxes with high melting points (e.g., about 71–74° C.) to confer hardness are described in U.S. Pat. No. 2,444,357.

Sprocket and chain mechanisms such as those used on bicycles and motorcycles are complex structures that require lubrication, that are typically used in wet and/or dusty environments. Moreover, these mechanisms are often exposed to relatively high temperatures during use. Non-tacky (i.e., dry or low viscosity) lubricants are preferred for use on bicycle chains or similar mechanisms to prevent accumulation of dust and dirt, and, thus, to prevent abrasion. Although greases accumulate dirt, they are often used to provide even power transmission because of their lubricating capacity on rollers of the chain, which are subject to unbalanced and relatively high pressure on the cross axis, and on sprocket teeth and the outside surface of the rollers, which are subject to shearing contact.

Paraffin-based soap-containing lubricants, such as those disclosed in U.S. Pat. No. 5,472,625 and allowed U.S. patent application Ser. No. 08/566,680 have achieved considerable commercial success, particularly among sports bicyclists (e.g., WHITE LIGHTNING®, Leisure Innovations, Morro Bay, Calif.). These lubricants have the advantage of keeping chains clean by sloughing dirt off of the chain, along with a portion of the lubricant. Paraffin-based lubricants must, therefore, by reapplied relatively frequently (e.g., about every 200 miles for bicycle use).

For high performance or professional bicyclists, however, paraffin-based lubricants may not provide the even power transmission needed, for example, during competitive racing events. Because such events often take place in wet and/or dusty conditions, there is a need for a lubricant that will deliver high-performance lubrication with even power transmission under wet and dirty conditions.

Smooth, high-performance lubrication is also needed for power tools used in dusty environments, such as drills and saws used for fabricating wood, plastic and metal objects. Thus, there is a need for a high-performance dry lubricant suitable for use with metal, wood and plastic surfaces. Similarly, there is a need for a dry lubricant for application to powered or manually driven household appliances, office and gardening equipment. Additionally, there is a need for a lubricant for mechanisms that operate in hot, dusty or wet environments, such as computer printers, paper shredders and fishing reels, as well as near combustion engines found on motorcycles, powered lawn equipment, farm equipment, forklifts, and other industrial or construction equipment.

SUMMARY

The present invention is a silicone-wax based, dry lubricant that provides high-performance power transmission and lubrication under wet and/or dusty or dirty conditions. Different formulations of the lubricant provide preferred characteristics to the dry lubricant, such as increased water-resistance or faster drying when applied and the ability to apply at relatively low ambient temperatures. One embodiment of the invention is a high-performance silicone-wax based dry lubricant that does not retain dirt particles, but instead sloughs dirt off the mechanism.

According to the invention, there is provided a high-performance multipurpose lubricant including a silicone wax having a melting point of about 25 degrees C. to 49 degrees C., dissolved in a volatile solvent In one embodiment, the silicone wax is a methyl stearoxy dimethicone wax. The volatile solvent in the lubricant can be a hydrocarbon solvent that is a straight-chain hydrocarbon having from 5 to 8 carbon atoms, and boiling points between about 35° C. and 110° C., an aromatic hydrocarbon, a chlorinated hydrocarbon, or an ether.

In another embodiment, the volatile solvent is pentane, hexane, heptane, toluene, benzene, xylene, perchloroethylene, chlorobenzene, naphthas, oil of turpentine, kerosene, monomethyl ether or ethylene glycol dimethyl ether. Preferably, the volatile solvent is hexane or heptane. In one embodiment, the silicone wax is about 5% to about 80% by weight of the lubricant. In another embodiment, the silicone wax is about 5% to about 10% by weight of the lubricant. The lubricant may also include a second non-silicone wax that is a natural or synthetic wax having a melting point of about 45° C. to about 70° C. In one embodiment, the second non-silicone wax includes a crystalline wax, microcrystalline wax, paraffin wax or mixtures thereof.

In another embodiment, the silicone wax is about 3% to about 40% by weight, the second non-silicone wax is about 5% to about 25% by weight, and the volatile solvent is about 20% to about 95% by weight of the lubricant. In one preferred embodiment, the silicone wax is about 3% to about 35% by weight, the second non-silicone wax is about 8% to about 20% by weight, and the volatile solvent is about 50% to about 85% by weight of the lubricant. In one embodiment, the silicone wax is a methyl $C_2$–$C_{30}$ alkoxy dimethicone wax that makes up about 31% by weight of the lubricant, the second non-silicone wax is a microcrystalline wax having a melting point of about 69° C. that makes up about 12% by weight of the lubricant, and the volatile solvent is hexane, making up about 56% by weight of the lubricant.

In another embodiment, the silicone wax is about 10% by weight of a methyl C2–C30 alkoxy dimethicone wax, the second non-silicone wax is about 16% by weight of a microcrystalline wax having a melting point of about 69° C., and the volatile solvent is about 74% by weight of hexane. In one embodiment, the lubricant also includes an insoluble particulate lubricant, which may be a salt of a fatty acid, or particulate dry polymer. In one embodiment, wherein the particulate lubricant that is a salt of a fatty acid, it is an aluminum, barium, calcium, lithium, magnesium or zinc salt of a stearic, oleic, linoleic or palmitic acid. In another embodiment, wherein the particulate lubricant is a particulate dry polymer, it is particulate polytetrafluoroethylene (PTFE). In one preferred embodiment, the lubricant includes methyl stearoxy dimethicone wax that makes up about 11% by weight, a microcrystalline wax having a melting point of about 69° C. and makes up about 11% by weight, hexane as the volatile solvent which makes up about 65% by weight, and the insoluble PTFE particles which make up about 0.2% by weight of the lubricant.

In another preferred embodiment, methyl stearoxy dimethicone wax is about 3.1% by weight, paraffin wax having a melting point of about 46.7° C. is about 8.8% by weight, hexane is the volatile solvent that is about 80.9% by weight, and calcium stearate or zinc stearate is about 7% by weight of the lubricant. In other embodiments, the lubricant may include a corrosion inhibitor, which preferably is 2-heptadecenyl-4,4(5h)oxazoledimethanol.

According to another aspect of the invention, there is provided a high-performance multipurpose lubricant consisting essentially of a silicone wax having a melting point of about 25 degrees C. to 49 degrees C. and a volatile solvent.

According to another aspect of the invention, there is provided a high-performance multipurpose solid lubricant consisting essentially of a silicone wax having a melting point of about 25 degrees C. to 49 degrees C., and a second non-silicone wax having a melting point in the range of about 45° C. to about 69° C., wherein the silicone wax and the second non-silicone wax are combined in a ratio of about 1:1 to about 2:1 by weight.

According to another aspect of the invention, there is provided a method of lubricating a solid surface that includes the steps of applying a lubricant that includes a silicone wax having a melting point of about 25 degrees C. to 49 degrees C., and a volatile solvent to a solid surface, and allowing the volatile solvent to evaporate to produce a relatively dry lubricant coating on the solid surface. The invention also includes a chain and sprocket mechanism coated with a relatively dry silicone wax according to this method.

DETAILED DESCRIPTION

This invention relates to lubricants that are based on silicone wax. Unlike conventional oil-based lubricants, embodiments of the present invention are dry lubricants that are excellent at sealing out and repelling dirt and water. Preferably, the silicone wax is a solid at room temperature (25° C.) so that the lubricant remains dry after application. The term "wax" refers to a well-understood solid state of matter that is distinct from highly viscous liquids, such as heavy oils, greases and gels.

In one embodiment, the silicone wax has alkyl or aryl groups linked to a polysiloxane backbone. The polysiloxane backbone can have 3–120 Si-O units. The basic structure of an exemplary polysiloxane backbone is shown below with (R) representing potential pendant groups:

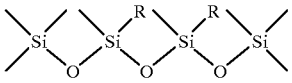

In addition, pendant groups (R) ranging from $C_2H_5$ to $C_{36}H_{73}$ and greater can be attached to the polysiloxane backbone. Pendant groups such as alkyl phenyl, phenyl, chlorophenyl, alkyl chlorophenyl, lipids, organo-lipids, phospholipids, perfluoro alkyl and fluoro alkyl groups can all be advantageously linked to the polysiloxane backbone. The pendant groups can be linked to the polysiloxane backbone via an oxygen, sulfur, carbonyl group, or by direct carbon-to-silicon binding. The pendant groups can also be attached by phosphate esters or by any other suitable linking group. Pendant groups comprising fatty acid esters or ethers having 10–30 carbon atoms and from 0 to 4 sites of unsaturation are specifically contemplated preferably having from 12 or 14 to 22 or 24 carbon atoms. Alkyl pendant groups having the same number of carbon atoms and liked through any suitable linking atom or group are also contemplated.

The silicone wax can, for example, be a silicone alkyl ester or silicone alkyl ether. Examples of silicon alkyl ester waxes are MIRASIL® WAX S and MIRASIL® WAX B (Rhone-Poulenc). Preferably, the silicone wax in these lubricants is a solid at room temperature so that the lubricant remains dry after application.

Many silicone waxes are known and/or are commercially available. Silicone waxes useful in the lubricants of the present invention can also be readily synthesized using well-known reactions as set forth, e.g., in *Silicone-based Polymer Science, A Comprehensive Reference,* 1989, J. M.

Zeigler and F. W. Gordon Fearon, the entirety of which is hereby incorporated by reference.

For example, using conventional silicone chemistry, the silicone wax is made by first forming the Si—O backbone through a chain equilibrium. If Si—H members are present, the reaction is carried out under acidic conditions. A solution of HCL, $F_3SO_3H$, $H_2SO_4$, acid clays, or acid exchange resins are used to synthesize the Si—O backbone. Depending on the desired chain length, the reaction can be carried out from room temperature to 100° C.

The proportion of Si—H groups in the final equilibrated chain determines the number of sites for attaching pendant groups. Thus, providing more Si—H groups in the final chain causes more pendant groups in the final polysiloxane molecule. Once the Si—O backbone is created, the excess acid is washed off before proceeding to the next step.

The characteristics of the final silicone wax can be determined by varying concentrations of the reactants. For example, holding all other components constant, the following changes produce the following results. Increasing the amount DC1107 fluid increases the number of reactive sites along the backbone for pendant substitution. Increasing the amount of octamethyl tetrasiloxane increases the number of inactive, non-reactive sites along the polysiloxane backbone. Increasing the amount of hexamethyl disiloxane or tetramethyl disiloxane decreases the overall polysiloxane backbone length. Using tetramethyl disiloxane allows functional groups to be attached at the end of the polysiloxane chain, rather than in the middle of the chain (as a pendant group). All of these reaction conditions are general guidelines, whereas the precise stoichiometry must be applied in order to have exacting control over the final product's molecular composition.

To produce derivatized silicon chains with a methyl endcap, cyclo octamethyl tetrasiloxane, a reactive polydinethyl siloxane (such as DC1107), and hexamethyl disiloxane are reacted. To produce a derivatized silicon chain with non-methyl end caps, tetramethyl disiloxane is used in place of the hexamethyl disiloxane. If the reactants are volatile, the reaction is carried out under a layer of nitrogen.

Once the Si—O chain is synthesized, the desired pendant group is added to the backbone. If the pendant group is an alcohol derivative, it is added to the equilibrated polysiloxane chain over potassium hydroxide (KOH) at less than 100° C. in a dehydrocondensation reaction. If the pendant group is an alkene or acetylene, the reaction is carried out over a Pt complex catalyst. This Platinum (Pt) catalyzed reaction is very exothermic. Additionally, an excess of pendant material must be used as some isomerization is inevitable. If the reactants are volatile, the reaction should be carried out under a nitrogen layer. These basic steps allow provide guidance for preparing polysiloxane chains with a wide variety of pendant groups.

In another embodiment, the lubricant is based on silicone wax that has a short dimethicone chain. Such compounds include methyl ($C_2$–$C_{30}$) alkoxy dimethicone. Commercially available methyl alkoxy dimethicone silicone waxes include MASILWAX 135™ (PPG Industries, Inc.) (a methyl stearoxy dimethicone) and similar products from other manufacturers (Dow Chemical Co. and Rhone Poulenc).

In one embodiment, the silicone wax is melted to a minimum of 10 degrees C. above its melt point to form a liquid having a viscosity similar to that of water. It is preferred that the surface is heated to the wax melt point or above. The melted silicone wax is then applied to the surface to be lubricated and excess wax is wiped off before the wax solidifies. Cooling causes the wax to solidify forming a lubricating film on the surface.

Generally, the silicone wax is combined with a second non-silicone wax, such as a crystalline (including microcrystalline) wax, paraffin wax, Fischer-Tropsch wax or low molecular weight polyethylene to form a wax mixtureBy "wax mixture" is meant a combination of a silicone wax and one or more second waxes. The second wax preferably has a melting point of about 25° C. to about 100° C. Other suitable second waxes include synthetic carbon waxes, microcrystalline waxes, hydrogenated triglycerides, synthetic spermaceti, and natural (e.g., carnauba wax, candelilla wax) or synthetic waxes with similar melting point characteristics. The ratio of the silicone wax to the second wax can be about equal (1:1) or one wax can be in excess. In some formulations, the silicone wax:second wax ratio can be about 1:3 or 3:5, whereas, in other formulations, the silicone wax can exceed the second wax producing a ratio of about 10:1 or about 5:2.

The silicone wax and second wax can be simply melted together at an appropriate temperature for the combination of the waxes (e.g., about 30° C. to about 105° C.), based on the ratios and melting points of the wax mixture, which can be readily determined empirically or by calculation by those skilled in the art. The melted wax mixture is thoroughly mixed, and then applied as a liquid to the surface to be lubricated, as described above. Alternatively, the melted wax mixture can be allowed to cool and solidify and then applied as a solid to the surface, particularly to a hot metal surface. To aid in application to cooler surfaces, the solid lubricant may be shaved, crushed or otherwise pulverized for dry application to the surface to be lubricated.

It will be appreciated by those skilled in the art that the melted silicone wax alone or the wax mixture may be granulated by spraying the melted wax mixture as small droplets into cooled ambient air to produce fine particles suitable for use as a dry lubricant that is subsequently sprayed or wiped onto the surface to be lubricated. Any of these powdered forms of the lubricant can be readily combined using well known methods with a suitable aerosol carrier (e.g., a highly volatile fluorocarbon) to produce a suspension for distributing the dry lubricant to a surface. Alternatively, the dry powdered lubricant may simply be suspended in a column of pressured air, $CO_2$, fluorocarbon, or other gas for aerosol distribution. The powdered lubricant can also be applied to a cloth or brush for wiping on the surface to be lubricated.

Powered lubricants can also be prepared by cooling or freezing the silicone wax or wax mixture, followed by grinding by spray drying a melted wax, or wax dissolved in a solvent, or an emulsified form of the wax, or by any other suitable micronizing or fragmenting technique.

For formulations in which lubricant is applied to an uneven surface, such as a bicycle chain, the preferred silicone-wax based lubricant includes a volatile solvent to aid in distribution and penetration of the lubricant onto all surfaces to be lubricated. Such formulations are a combination of a silicone wax, at about 5% to about 80% by weight, and a volatile solvent, at about 20% to about 95% by weight. For a silicone-based lubricant that is a wax mixture, the formulations include a silicone wax, a second wax or waxes, and a volatile solvent. The silicone wax is about 3% to about 40% by weight, preferably about 3% to about 35% by weight. The second wax is about 5% to about 25% by weight, preferably about 8% to about 20% by weight. And the volatile solvent is about 35% to about 90% by weight, preferably about 50% to about 85% by weight.

The volatile solvent is a hydrocarbon solvent that is a straight-chain hydrocarbon having from 5 to 8 carbon atoms, and boiling points between about 35° C. and 110° C., such as pentane, hexane or heptane; or aromatic hydrocarbons, such as toluene, benzene and xylene. The solvent may also be a chlorinated hydrocarbon solvent, such as perchloroethylene or chlorobenzene. Other solvents such as naphthas, oil of turpentine and kerosene are also suitable. The toxicity of certain solvents (e.g., toluene, benzene, perchloroethylene) make them unsuitable for applications such as lubricants for food-handling equipment. Ethers such as monomethyl ether, ethylene glycol dimethyl ether and the like may be used as a volatile solvent. Preferred solvents are hexane and heptane, based on their low toxicity, high solubility and cost considerations. Because the solvent is evaporated from the dry lubricant in its final state, it is considered merely a carrier of the lubricant and, therefore, is not considered to be a basic component. The carrier could be water (as an emulsion or a suspension) for example, or water and alcohol. Therefore, any liquids or mixtures of liquids having the capacity to dissolve, suspend or emulsify the silicone wax and any second wax included in the formulation would be suitable. Examples of other hydrocarbon solvent systems include any mixture of the following hydrocarbons:

| | |
|---|---|
| Linear | $C_5H_{12}$—$C_{10}H_{22}$, 0.65 cst siliconal fluid |
| Ring | $C_6H_{12}$—$C_{10}H_{20}$ |
| Branched | 2-methylpentane, 3-methylpentane<br>2-methylhexane, 3-methylhexane |
| Siliconal Rings | $(SiMeO)_4$, Dow Corning 244<br>$(SiMeO)_6$, $(SiMeO)_8$ |

Corrosion inhibitors are optionally included in the lubricant formulations to supply the protection against metal corrosion typical of such well known compounds. When added to the lubricant formulations, the corrosion inhibitors are included in a range of about 0.01% (w/w) to about 5% (w/w), preferably about 0.1% (w/w/) to about 0.5% (w/w), and more preferably about 0.1% (w/w) to about 0.2% (w/w) of the formulation. Corrosion inhibitors include anti-oxidant compounds, such as, for example, anilines, α- or β-naphthol, hydroquinones, diphenyl-guanidine and similar compounds. Other corrosion inhibitors are magnesium oxide-sulfonate complexes as disclosed in U.S. Pat. No. 4,260,500. A preferred corrosion inhibitor is 2-heptadecenyl-4,4(5h) oxazoledimethanol.

Some formulations of the silicone-wax base lubricant include an insoluble particulate, such as a salt of a fatty acid (i.e., a soap) or particulate dry polymer lubricant, such as polytetrafluoroethylene (PTFE), dispersed in the volatile solvent-based solution of the silicone wax and a second wax. The silicone wax-based lubricant that contains a soap or particulate polymer lubricant is a suspension having good penetrating characteristics, allowing the suspension to flow along the surfaces and penetrate crevices to be lubricated, thus distributing the soap or dry polymer particles uniformly within the wax film formed on the surface.

After evaporation of the solvent, the mixture of wax and soap or particulate lubricant forms a solid, relatively dry coating or film on the surface of the mechanism. Dirt particles that contact the wax film and are not repelled, combine with the wax film and destabilized it. The wax film becomes an ablative layer, forming flakes of dirt-carrying soap or dry lubricant that slough off the mechanism when it is exposed to dirt, grit or other contaminants. The rate of sloughing may be adjusted by combining different amounts or sizes of soap or particulate polymer lubricants in the silicone wax-based lubricant.

Suitable soaps for inclusion in the lubricant are salts of a fatty acid, where the fatty acid is preferably a myristic, stearic, oleic, linoleic or palmitic acid, and the salt is a metal, preferably aluminum, barium, calcium, lithium, magnesium or zinc. Other metallic soaps, such as naphthenate and laureates, are also suitable.

Suitable dry particulate lubricants are solid fluorocarbon polymers, such as polytetrafluoroethylene (PTFE) fluorotelomers (which is commercially available as KRYTOX DF®, Dupont) and pulverized PTFE polymeric solids (i.e., TEFLON® powder, Dupont). Other fine particulate solids may be substituted (e.g., graphite, powdered polymers, such as polyvinylchloride and polypropylene) but lubricants containing these dry particulates may be limited to applications because of their color or lower melting points compared to particulate PTFE.

The lubricant can also include a stable emulsion. Usually two separate surfactants are used to create the stable emulsion with the surfactant choice being governed by the pendant groups. An example of creating an emulsion can be found below in Example 8.

Application of the Lubricants to Mechanisms

Any of a variety of well known methods of application are suitable for application of the lubricants of the present invention to surfaces. That is, the lubricants may be applied by dripping, pouring, squirting liquid lubricant or spraying an aerosol of the liquid lubricant on the parts of the mechanism to be lubricated. For liquid formulations that include a volatile solvent, excess liquid is wiped off of the surface and the wax is allowed to solidify into a lubricating film. For solvent-containing formulations, the volatile solvent is allowed to evaporate at ambient temperatures to leave a lubricant film on the treated surface.

A powdered form of a solid silicone wax-based lubricant can be applied as a suspension in an inert carrier or as fine dry particles to the surface to be lubricated. A suspension or fine powder may be aerosolized and sprayed onto the surface. Alternatively, the dry powdered form of the lubricant may be rubbed onto the mechanism.

Applicators may be used to apply the liquid or powdered forms of the silicone wax-based lubricant to mechanism parts. Applicators may be simply a lubricant-imbued woven or non-woven fabric for wiping the lubricant on the surface, or a brush for painting a coating of the lubricant onto the surface. Specialized applicators may be used for lubricating particular mechanisms such as drive chains of bicycles or motorcycles as disclosed in U.S. Pat. No. 5,213,180.

The following non-limiting examples describe preferred formulations of the silicone wax-based dry lubricant. Example 1 describes silicone wax and solvent formulations suitable for lubrication at different temperatures. Examples 2–5 describe formulations that are admixtures of a silicone wax and a second wax in a volatile solvent. Example 6 describes a melted wax mixture as a lubricant for a bicycle chain. Example 7 describes a solid wax mixture suitable to pulverization for application of a dry powdered lubricant.

EXAMPLE 1

This embodiment combined a silicone wax with a volatile solvent for effective applications of dry lubricant at different temperatures. In one formulation, about 5% to about 10% by weight of methyl stearoxy dimethicone was dissolved in about 90% to 95% by weight hexane. The resulting solution had low viscosity even at freezing temperatures, making it suitable for applications at about −18° C. to 0° C. Other formulations were hexane solutions containing up to about 80% by weight of methyl stearoxy dimethicone. These formulations were found to be effective lubricants at temperatures of about 25° C. to about 49° C., particularly when applied to the surface at about 25 degrees C. or higher. For lubrication at higher temperatures, a mixture of the silicone wax and a second wax are preferred.

EXAMPLE 2

This embodiment of the invention combined a silicone wax with a microcrystalline wax to improve performance. The lubricant was stable at temperatures of about 25° C. to about 49° C. and was found to be effective and long lasting under very wet and/or extremely dusty conditions (i.e., as experienced during competitive Cross Country mountain bike racing).

Ten parts (31% w/w) of methyl stearoxy dimethicone and four parts (12% w/w) of microcrystalline wax (having a melting point of 68.9° C. (156° F.) were both dissolved in eighteen parts (56% w/w) hexane. The admixture was thoroughly mixed and 0.2 parts (0.1% w/w) of an optional corrosion inhibitor, 2-heptadecenyl-4,4(5h) oxazoledimethanol, was added to produce the final lubricant.

The final formulation was stored in a sealed container at ambient temperature, generally about 25° C., but occasionally ranging from about 0° C. to about 37° C.

EXAMPLE 3

This embodiment combined a silicone wax with a microcrystalline wax to improve performance and stability at lower temperatures (about 0° C. to about 49° C.). This formulation included a larger amount of volatile solvent to promote faster drying of the lubricant, particularly during applications at colder ambient temperatures (e.g., about 0° C. to about 10° C.).

This lubricant formulation included three parts (10% w/w) of methyl stearoxy dimethicone and five parts (16% w/w) of microcrystalline wax (having a melting point of 68.9° C. (156° F.) dissolved in 23 parts (74% w/w) hexane. As in Example 1, an optional corrosion inhibitor was included at 0.2 parts (0.1% w/w). This lubricant was prepared and stored essentially as described in Example 2.

EXAMPLE 4

This silicone wax-based lubricant included a dry particulate component to add lubrication and to promote sloughing of dirt or dust, and a microcrystalline wax to improve performance and stability. This formulation also included a relatively large amount of volatile solvent to promote faster drying of the lubricant at cooler ambient temperatures (about −5° C. to about 15° C.). This formulation was found to have excellent water-resistant properties.

The lubricant was prepared by mixing four parts (11% w/w) of methyl stearoxy dimethicone, four parts (11% w/w) of microcrystalline wax (having a melting point of 68.9° C. (156° F.), four parts of a 20% suspension of polytetrafluoroethylene (PTFE) fluorotelomers (0.22% w/w PTFE) in a solvent and 23 parts (65% w/w) of hexane. A corrosion inhibitor, 2-heptadecenyl-4,4(5h)oxazoledimethanol was added at 0.2 parts (0.2% w/w).

The PTFE fluorotelomer suspension can be equally substituted with finely pulverized PTFE solids (e.g., ranging from about 0.1 $\mu$ to about 50 microns). This formulation was stored essentially as described in Example 2. Before application, the formulation was shaken thoroughly to resuspend the PTFE particles evenly in the mixture.

EXAMPLE 5

This embodiment combined a silicone wax with a soap particulate lubricant to promote sloughing of dirt or dust, paraffin wax, and a large amount of volatile solvent. It had performance characteristics similar to those of the lubricant described in Example 3. The large amount of solvent in this formulation made it particularly suitable for applications at colder ambient temperatures (about 0° C. to about 10° C.). For this formulation, 3.1 parts (3.1% w/w) of methyl stearoxy dimethicone and 8.8 parts (8.8% w/w) of paraffin wax (having a melting point of 46.7° C. (116° F.) were dissolved in 80.9 parts (80.9% w/w) of hexane and 7.0 parts (7.0% w/w) of calcium stearate and 0.2 parts (0.2% w/w) of 2-heptadecenyl-4,4(5h)oxazoledimethanol were added to the solution.

Zinc stearate or other metal salts of fatty acids or alcohols may be substituted for the calcium stearate component. This formulation was stored essentially as described in Example 2.

EXAMPLE 6

This embodiment combines a silicone wax with a paraffin wax to produce a wax mixture that can be melted and applied as a liquid to a bicycle chain. The wax mixture includes two parts by weight methyl stearoxy dimethicone having a melting point of about 45° C. and one part by weight of paraffin wax having a melting point of about 47° C. The mixture is melted together at about 50–100° C., mixed thoroughly and applied by removing the chain and dipping it into the melted mixture. Excess wax is wiped off the chain and the remainder on the chain is allowed to cool and dry at ambient temperature to form a film of silicone wax-based lubricant on the chain. The remaining portion of the mixture is allowed to cool to room temperature. For reapplication, the remaining portion is again melted by heating to about 50–100° C., and the process of applying the lubricant is repeated.

EXAMPLE 7

This embodiment combines a silicone wax with a microcrystalline wax having a melting point of about 69° C. to produce a solid wax mixture suitable for producing a powdered formulation. A mixture of about 1:1 methyl stearoxy dimethicone having a melting point of about 45° C. and a microcrystalline wax having a melting point of about 69° C. is prepared by melting the two waxes together at about 57–60° C. and mixing thoroughly. The mixture is either allowed to cool and then crushed into fine particles, or is shot sprayed into ambient air to produce fine particles. The dry particles range from about 0.001–1 mm in largest dimension, preferably about 0.01–0.05 mm in largest dimension. The particles can be suspended in a fluorocarbon for aerosol dispersion using well-known methods or provided in a container that permits air pressure to disperse the particles when dispensed through an appropriately sized orifice (e.g., a squeeze bottle).

EXAMPLE 8

A sorbitan ester, S-MAZ (80K) (BASF), is added to methyl stearoxy dimethicone silicone wax. Separately, an ester ethoxylate, T-MAZ (80K) (BASF), is added to water.

The wax mixture and the water mixture are heated to 80° C. and the water mixture is slowly added to the wax mixture under high shear to a final concentration of 1:1.85 of S-MAZ to T-MAZ. The final result is an emulsion with up to 35% and greater of silicone wax in water, v/v. The total weight of both surfactants combined equals about 10% to 20% of the total wax weight of the mixture. The total solids are found to be 25% of the total mixture weight. The surfactants are 2.5% of the total mixture weight.

While particular embodiments of the invention have been described in detail, it will be apparent to those skilled in the art that these embodiments are exemplary rather than limiting, and the true scope of the invention is defined by the claims that follow.

What is claimed is:

1. A high-performance multipurpose lubricant consisting essentially of a silicone wax having a melting point of about 25° C. to about 49° C., a corrosion inhibitor and a volatile solvent.

2. A high-performance multipurpose solid lubricant consisting essentially of a silicone wax having a melting point of about 25° C. to about 49° C., and a second wax having a melting point in the range of about 45° C. to about 100° C., wherein the silicone wax and the second wax are combined in a ratio of about 1:1 to about 2:1 by weight, and wherein said second wax is a non-silicone wax.

3. The lubricant of claim 1, wherein the corrosion inhibitor is 2-heptadecenyl-4,4 (5h) oxazoledimethanol.

4. The lubricant of claim 1, wherein the silicone wax comprises a methyl $C_2$–$C_{30}$ alkoxy dimethicone wax.

5. The lubricant of claim 1, wherein the silicone wax has aryl or alkyl pendant groups.

6. The lubricant of claim 5, wherein the pendant group has 2–30 carbon atoms.

7. The lubricant of claim 1, wherein the volatile solvent comprises a hydrocarbon solvent that is a straight-chain hydrocarbon having from 5 to 8 carbon atoms, and boiling points between about 35° C. and 110° C., an aromatic hydrocarbon, a chlorinated hydrocarbon, or an ether.

8. The lubricant of claim 1, wherein the volatile solvent comprises pentane, hexane, heptane, toluene, benzene, xylene, perchloroethylene, chlorobenzene, naphthas, oil of turpentine, kerosene, monomethyl ether or ethylene glycol dimethyl ether.

9. The lubricant of claim 1, wherein the volatile solvent comprises hexane or heptane.

10. The lubricant of claim 1, wherein the silicone wax comprises about 5% to about 80% by weight of the lubricant.

11. The lubricant of claim 2, wherein said second wax is selected from the group consisting of a crystalline wax, microcrystalline wax, and a paraffin wax.

12. The lubricant of claim 2, wherein the silicone wax comprises about 31% by weight of a methyl $C_2$–$C_{30}$ alkoxy dimethicone wax and the second wax comprises about 8% to about 20% by weight.

13. The lubricant of claim 2, wherein the silicone wax comprises about 10% by weight of a methyl $C_2$–$C_{30}$ alkoxy dimethicone wax and the second wax comprises about 16% by weight of a microcrystalline wax having a melting point of about 69° C.

14. The lubricant of claim 2, wherein the silicone wax has aryl or alkyl pendant groups.

15. The lubricant of claim 14, wherein the pendant group has 2–30 carbon atoms.

16. A method of lubricating a solid surface, comprising the steps of:

applying a lubricant consisting essentially of a silicone wax having a melting point of about 25° C. to about 49° C., a volatile solvent, and a second wax having a melting point in the range of about 45° C. to about 100° C., wherein the silicone wax and the second wax are combined in a ratio of about 1:1 to about 2:1 by weight and wherein said second wax is a non-silicone wax to a solid surface; and allowing the volatile solvent to evaporate to produce a lubricant coating on the solid surface.

17. The method of claim 15, wherein the volatile solvent comprises a hydrocarbon solvent that is a straight-chain hydrocarbon having from 5 to 8 carbon atoms, and boiling points between about 35° C. and 110° C., an aromatic hydrocarbon, a chlorinated hydrocarbon, or an ether.

18. The method of claim 15, wherein the volatile solvent comprises pentane, hexane, heptane, toluene, benzene, xylene, perchloroethylene, chlorobenzene, naphthas, oil of turpentine, kerosene, monomethyl ether or ethylene glycol dimethyl ether.

19. The method of claim 15, wherein the volatile solvent comprises hexane or heptane.

20. A method of lubricating a solid surface, comprising the steps of:

applying a lubricant consisting essentially of a silicone wax having a melting point of about 25° C. to about 49° C., a corrosion inhibitor and a volatile solvent to a solid surface; and allowing the volatile solvent to evaporate to produce a lubricant coating on the solid surface.

* * * * *